US008986917B2

(12) United States Patent
Morales-Tirado et al.

(10) Patent No.: US 8,986,917 B2
(45) Date of Patent: Mar. 24, 2015

(54) TONER COMPOSITION HAVING IMPROVED CHARGE CHARACTERISTICS AND ADDITIVE ATTACHMENT

(71) Applicant: Xerox Corporation, Norwalk, CT (US)

(72) Inventors: Juan A. Morales-Tirado, Henrietta, NY (US); Blaise Luzolo, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 63 days.

(21) Appl. No.: 13/832,621

(22) Filed: Mar. 15, 2013

(65) Prior Publication Data

US 2014/0272697 A1 Sep. 18, 2014

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/093*** | (2006.01) |

(52) U.S. Cl.

CPC ..... *G03G 9/0821* (2013.01); *G03G 9/0808* (2013.01); *G03G 9/0804* (2013.01); *G03G 9/0823* (2013.01); *G03G 9/08711* (2013.01); *G03G 9/09392* (2013.01)

USPC ..... 430/137.14; 430/108.1; 430/108.6; 430/108.7; 430/109.3

(58) Field of Classification Search

USPC ..... 430/108.1, 108.6, 108.7, 109.3, 137.14

See application file for complete search history.

(56) References Cited

U.S. PATENT DOCUMENTS

| | | | | |
|---|---|---|---|---|
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,298,672 | A | 11/1981 | Lu | |
| 4,338,390 | A | 7/1982 | Lu | |
| 5,702,858 | A * | 12/1997 | Yuasa et al. | 430/108.6 |
| 6,004,714 | A | 12/1999 | Ciccarelli et al. | |
| 6,190,815 | B1 | 2/2001 | Ciccarelli et al. | |
| 6,599,673 | B2 | 7/2003 | Kumar et al. | |
| 2003/0063521 | A1 * | 4/2003 | Kumar et al. | 366/314 |
| 2003/0104296 | A1 * | 6/2003 | Hamano et al. | 430/107.1 |
| 2011/0003243 | A1 * | 1/2011 | Sacripante et al. | 430/109.4 |
| 2012/0028181 | A1 * | 2/2012 | Nair et al. | 430/108.6 |

FOREIGN PATENT DOCUMENTS

| | | |
|---|---|---|
| EP | 1 442 835 A1 | 8/2004 |

* cited by examiner

*Primary Examiner* — Peter Vajda

(74) *Attorney, Agent, or Firm* — Pillsbury Winthrop Shaw Pittman LLP

(57) ABSTRACT

A method of making a toner composition includes preparing raw toner particles, increasing a surface area of the raw toner particles by contacting the raw toner particles with a base to produce base-treated raw toner particles, and mixing the base-treated raw toner particles with at least one surface additive such that the at least one surface additive attaches to a surface of the base-treated raw toner particles to obtain blended toner particles. A toner composition includes blended toner particles containing base-treated raw toner particles, and at least one surface additive attached to a surface of the base-treated raw toner particles, wherein a ratio of a triboelectric charge of the blended toner composition to a triboelectric charge of the base-treated raw toner particles is from about 0.8 to about 1.2.

20 Claims, 1 Drawing Sheet

TONER COMPOSITION HAVING IMPROVED CHARGE CHARACTERISTICS AND ADDITIVE ATTACHMENT

TECHNICAL FIELD

This disclosure is directed to toner compositions having improved charge characteristics and additive attachment, and methods of making such toners.

BACKGROUND

In some toner formulations, including some emulsion aggregation (EA) toner formulations, some chemical toners, and some conventional toners, the toner particles are treated with one or more surface additives (herein "surface additive"), such as a charge control agent, to form surface-treated particles comprising a parent particle having an outer surface to which surface additive is adhered. In some cases, the charge of the toner particles before being treated with surface additive is higher than that of the final surface additive-treated toner particles. Thus, the charge of the parent particle surface is higher than the charge of the surface-treated toner particles. Depending on the development system and the toner age, this characteristic can lead to charge instability, which can then lead to density variation and limited toner gamut in color toners. This charge instability is the result of increasing exposure of the higher-charged parent particle surface over time due to surface additive being rubbed off of the particle surface, being transferred to the carrier, such as in the case of two component development (TCD) systems, and/or the surface additive being impacted into the particle.

SUMMARY

Provided is a method of making a toner composition comprising preparing raw toner particles; increasing a surface area of the raw toner particles by contacting the raw toner particles with a base to produce base-treated raw toner particles; and mixing the base-treated raw toner particles with at least one surface additive such that the at least one surface additive attaches to a surface of the base-treated raw toner particles to obtain blended toner particles.

Also provided is a toner composition comprising blended toner particles comprising base-treated raw toner particles; and at least one surface additive attached to a surface of the base-treated raw toner particles, wherein a ratio of a triboelectric charge of the blended toner composition to a triboelectric charge of the base-treated raw toner particles is from about 0.8 to about 1.2.

Additionally provided is a toner composition comprising blended toner particles comprising base-treated raw toner particles; and at least one surface additive attached to a surface of the base-treated raw toner particles, wherein a degree of attachment between the bare toner particles and the at least one surface additive is from about 10 to about 40%; a BET specific surface area of the base-treated raw toner particles is greater than about 1.5 $m^2/g$. a ratio of a triboelectric charge of the blended toner particles to a triboelectric charge of the base-treated raw toner particles is from about 0.8 to about 1.2; the triboelectric charge of the base-treated raw particles is from about 26 to about 58 μC/g; and the triboelectric charge of the blended toner particles is from about 32 to about 48 μC/g.

EMBODIMENTS

Figure 1:
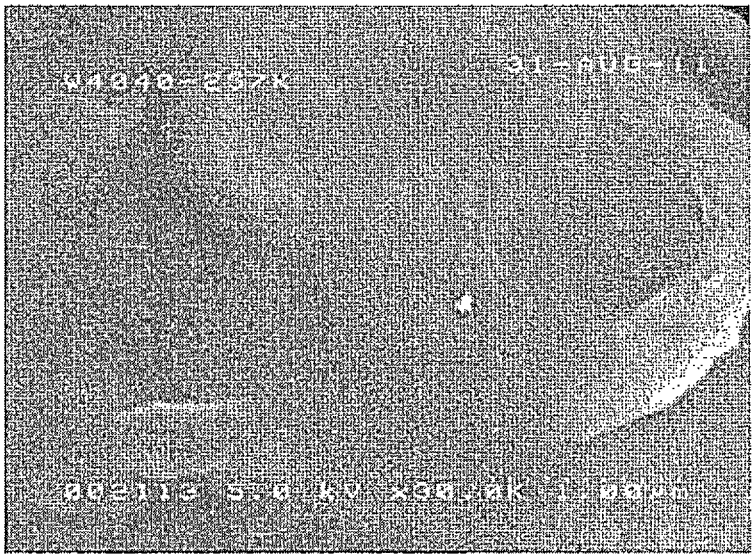
FIG. 1 is a scanning electron microscope (SEM) image of a raw toner particle that has not been treated with a base.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

"Optional" or "optionally" refer, for example, to instances in which subsequently described circumstances may or may not occur, and include instances in which the circumstance occurs and instances in which the circumstance does not occur.

The phrases "one or more" and "at least one" refer, for example, to instances in which one of the subsequently described circumstances occurs, and to instances in which more than one of the subsequently described circumstances occurs.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The term "raw toner particle" refers to a toner particle before being blended or treated with surface additive.

The term "base-treated raw toner particle" refers to a raw toner particle that has been treated with a base.

The term "blended toner particle" refers to a raw toner particle that has been blended or treated with surface additive. The term "blended toner" refers to a composition comprising blended toner particles.

Disclosed herein are toner compositions comprising toner particles comprising a core having an outer surface to which a surface additive is adhered, in which the triboelectric charge of the core surface is similar to or the same as the triboelectric charge of the surface of the toner particle. Also disclosed is a toner composition comprising such toner particles and having a stable charge distribution. Thus, even when areas of core surfaces become exposed over time due to, for example, portions of surface additive rubbing off of or being impacted into the cores, charge inequality within the toner composition is minimized.

Also disclosed are methods of making such toner compositions, which includes pretreating raw toner particles to modify the surface chemistry and morphology of the raw toner particles before the raw toner particles are blended with surface additive. These modifications may be used to adjust the surface charge of the raw toner particles to be similar to or the same as the charge of the blended toner. Additionally, these modifications may be used to facilitate stronger attachment of surface additive to the raw toner particles in a blended toner. Consequently, blended toners made according this disclosure exhibit improved charge characteristics and additive attachment. Thus, charge stability is improved, density variation is suppressed, and color stability in color toners is improved. Also, the amount of loose additives in the toner, which can lead to image quality artifacts, is reduced.

Resins and Polymers

Any monomer suitable for preparing a latex for use in a toner may be used in forming the raw toner particles. Suitable monomers include styrenes, acrylates, methacrylates, butadienes, isoprenes, acrylic acids, methacrylic acids, acrylonitriles, combinations thereof, and the like.

Suitable toner resins include thermoplastic resins such as vinyl resins or styrene resins, and polyesters. Suitable thermoplastic resins include styrene methacrylate; polyolefins; styrene acrylates, such as PSB-2700 obtained from Hercules-Sanyo Inc.; styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include styrene; p-chlorostyrene; unsaturated mono-olefins such as ethylene, propylene, butylene, isobutylene, and the like; saturated mono-olefinins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; mixtures thereof; and the like. In addition, crosslinked resins, including polymers, copolymers, and homopolymers of styrene polymers, may be selected.

The latex polymer may include at least one polymer. Exemplary polymers include styrene acrylates, styrene butadienes, styrene methacrylates, and more specifically, poly (styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly (acrylonitrile-butyl acrylate-acrylic acid), and combinations thereof. The polymers may be block, random, or alternating copolymers.

A poly(styrene-butyl acrylate) may be used as the latex polymer. The glass transition temperature of this latex may be from about 35° C. to about 75° C., such as from about 40° C. to about 70° C.

Waxes

In addition to the resin, the toner particles may also contain a wax, either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Suitable waxes include natural vegetable waxes, natural animal waxes, mineral waxes, synthetic waxes, and functionalized waxes. Suitable natural vegetable waxes include carnauba wax, candelilla wax, rice wax, sumacs wax, jojoba oil, Japan wax, and bayberry wax. Suitable natural animal waxes include beeswax, punic wax, lanolin, lac wax, shellac wax, and spermaceti wax. Suitable mineral-based waxes include paraffin wax, microcrystalline wax, montan wax, ozokerite wax, ceresin wax, petrolatum wax, and petroleum wax. Suitable synthetic waxes include Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

The wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is totally incorporated herein by reference.

The toner particles may contain the wax in an amount of, for example, from about 1 to about 25 wt % of the toner particles, such as from about 3 to about 15 wt %, or from about 5 to about 20 wt %, or from about 5 to about 12 wt %.

The wax may be a paraffin wax. Suitable paraffin waxes include paraffin waxes possessing modified crystalline structures, which may be referred to herein as modified paraffin waxes. Compared with conventional paraffin waxes, which may have a symmetrical distribution of linear carbons and branched carbons, the modified paraffin waxes may possess branched carbons in an amount of from about 1 to about 20 wt % of the wax, such as from about 8 to about 16 wt %, with linear carbons present in an in amount of from about 80 to about 99 wt %, or from about 84 to about 92 wt %.

In addition, the isomers, i.e., branched carbons, present in such modified paraffin waxes may have a number average molecular weight (Mn), of from about 520 to about 600, such as from about 550 to about 570, or about 560. The linear carbons, sometimes referred to herein as normals, present in such waxes may have a Mn of from about 505 to about 530, such as from about 512 to about 525, or about 518. The weight average molecular weight (Mw) of the branched carbons in the modified paraffin waxes may be from about 530 to about 580, such as from about 555 to about 575, and the Mw of the linear carbons in the modified paraffin waxes may be from about 480 to about 550, such as from about 515 to about 535.

For the branched carbons, the weight average molecular weight (Mw) of the modified paraffin waxes may demonstrate a number of carbon atoms of from about 31 to about 59 carbon atoms, such as from about 34 to about 50 carbon atoms, with a peak at about 41 carbon atoms, and for the linear carbons, the Mw may demonstrate a number of carbon atoms of from about 24 to about 54 carbon atoms, or from about 30 to about 50 carbon atoms, with a peak at about 36 carbon atoms.

The modified paraffin wax may be present in an amount of from about 2 to about 20 wt % by weight of the toner particles, such as from about from about 4 to about 15 wt %, or from about 5 to about 13 wt %.

Colorants

The toner particles may also contain at least one colorant. Suitable colorants or pigments include pigment, dye, mixtures of pigment and dye, mixtures of pigments, mixtures of dyes, and the like. For simplicity, the term "colorant" refers to colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Additional suitable colorants include magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %.

Coagulants

Coagulants used in emulsion aggregation processes for making toners include monovalent metal coagulants, divalent metal coagulants, polyion coagulants, and the like. "Polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraallyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt %.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt %, or from about 1 to about 3 wt %.

Suitable nonionic surfactants include methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Initiators

Initiators may be added for formation of the latex polymer. Suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be used include azoamidine compounds, for example 2, 2'-azobis(2-methyl-N-phenylpropionamidine)dihydrochloride, 2,2'-azobis[N-(4-chlorophenyl)-2-methylpropionamidine] di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2 methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators may be added in suitable amounts, such as from about 0.1 to about 8 wt % of the monomers, or from about 0.2 to about 5 wt %.

Chain Transfer Agents

Chain transfer agents may also be used in forming the latex polymer. Suitable chain transfer agents include dodecane thiol, octane thiol, carbon tetrabromide, combinations thereof, and the like, in amounts from about 0.1 to about 10 wt %, such as from about 0.2 to about 5 wt % of monomers, to control the molecular weight properties of the latex polymer when emulsion polymerization is conducted in accordance with the present disclosure.

Secondary Latexes

A secondary latex may be added to non-crosslinked latex resin suspended in the surfactant. A secondary latex may refer to a crosslinked resin or polymer, or mixtures thereof, or a non-crosslinked resin that has been subjected to crosslinking.

The secondary latex may include submicron crosslinked resin particles having a size of from about 10 to about 200 nanometers in volume average diameter, such as from about 20 to 100 nanometers. The secondary latex may be suspended in an aqueous phase of water containing a surfactant, where the surfactant is present in an amount of from about 0.5 to about 5 wt % of total solids, such as from about 0.7 to about 2 wt %.

The crosslinked resin may be a crosslinked polymer such as crosslinked poly-styrene acrylates, poly-styrene butadienes, and/or poly-styrene methacrylates. Exemplary crosslinked resins include crosslinked poly(styrene-alkyl acrylate), poly(styrene-butadiene), poly(styrene-isoprene), poly(styrene-alkyl methacrylate), poly(styrene-alkyl acrylate-acrylic acid), poly(styrene-butadiene-acrylic acid), poly (styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly(alkyl acrylate-acrylonitrile-acrylic acid), and mixtures thereof.

A crosslinker, such as divinyl benzene or other divinyl aromatic or divinyl acrylate or methacrylate monomers, may be used in the crosslinked resin. The crosslinker may be present in an amount of from about 0.01 to about 25 wt % of the crosslinked resin, such as from about 0.5 to about 15 wt %.

The crosslinked resin particles may be present in an amount of from about 1 to about 20 wt % of the toner particles, such as from about 4 to about 15 percent by wt %, or from about 5 to about 14 wt %.

The resin used to form the toner may be a mixture of a gel resin and a non-crosslinked resin.

Functional Monomers

A functional monomer may be included when forming a latex polymer and the particles making up the polymer. Suitable functional monomers include monomers having carboxylic acid functionality. Such functional monomers may be of the following formula (I):

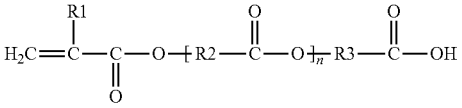

(I)

where R1 is hydrogen or a methyl group; R2 and R3 are independently selected from alkyl groups containing from about 1 to about 12 carbon atoms or a phenyl group; n is from about 0 to about 20, such as from about 1 to about 10. Examples of such functional monomers include beta carboxyethyl acrylate (β-CEA), poly(2-carboxyethyl)acrylate, 2-carboxyethyl methacrylate, combinations thereof, and the like. Other functional monomers that may be used include acrylic acid and its derivatives.

The functional monomer having carboxylic acid functionality may also contain a small amount of metallic ions, such as sodium, potassium, and/or calcium, to achieve better emulsion polymerization results. The metallic ions may be present in an amount from about 0.001 to about 10 wt % of the functional monomer having carboxylic acid functionality, such as from about 0.5 to about 5 wt %.

Where present, the functional monomer may be added in amounts from about 0.01 to about 5 wt % of the toner particles, such as from about 0.05 to about 2 wt %.

Aggregating Agents

Any aggregating agent capable of causing complexation may be used in forming toners of the present disclosure. Both alkali earth metal and transition metal salts can be utilized as aggregating agents. Alkali (II) salts can be selected to aggregate latex resin colloids with a colorant to enable the formation of a toner composite. Such salts include beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions suitable as aggregating agent include acetates of vanadium, niobium, tantalum, chromium, molybdenum, tungsten, manganese, iron, ruthenium, cobalt, nickel, copper, zinc, cadmium, or silver; acetoacetates of vanadium, niobium, tantalum, chromium, molybdenum, tungsten, manganese, iron, ruthenium, cobalt, nickel, copper, zinc, cadmium, or silver; sulfates of vanadium, niobium, tantalum, chromium, molybdenum, tungsten, manganese, iron, ruthenium, cobalt, nickel, copper, zinc, cadmium, or silver; and aluminum salts such as aluminum acetate, aluminum halides such as polyaluminum chloride, combinations thereof, and the like.

Shell

A shell may be formed on the aggregated particles. Any latex disclosed above used to form the raw toner particles may be used to form the latex shell. For example, a styrene-n-butyl acrylate copolymer may be used to form the shell latex. The shell latex may have a glass transition temperature of from about 35° C. to about 75° C., such as from about 40° C. to about 70° C.

Where present, a shell latex may be applied by any method within the purview of the art, including dipping, spraying, and the like. The shell latex may be applied until the desired final size of the toner particles is achieved, such as from about 3 to about 12 microns, such as from about 4 microns to about 9 microns. The shell latex may be prepared by in-situ seeded semi-continuous emulsion copolymerization of the latex and the shell latex can be added once aggregated particles have formed.

Where present, the shell latex may be present in an amount of from about 20 to about 40 wt % of the dry toner particle, such as from about 26 to about 36 wt %, or from about 27 to about 34 wt % of the dry toner particle.

Methods

The toners may be prepared by combining a latex resin, an optional wax, and an optional colorant in the aggregation process, coalescing the aggregated particles by heating the particles above a glass transition temperature of the latex to form raw toner particles, followed by treating the raw toner particles with a base, and then mixing the base-treated raw toner particles with at least one surface additive to form blended toner particles. The resin may be prepared by any method within the purview of the art. One way the resin may be prepared is by emulsion polymerization methods, including semi-continuous emulsion polymerization.

Particularly, the toner may be formed by forming a slurry containing an emulsion containing a resin, an optional wax, and an optional surfactant, and aggregating and coalescing the particles in the slurry to form the raw toner particles. The raw toner particles are then treated with a base, and mixed with at least one surface additive.

The raw toner particles may be treated with a base by adding a base to the raw toner particles in an amount of from about 3 to about 6 g of the base per kg of the raw toner particles, such as from about 3 to about 4.2 g, from about 4 to about 5 g, or from about 4.8 to about 6 g of the base per kg of raw toner particles. The base may be added until a pH of the mixture is from about 8 to about 10, such as from about 8.5 to about 10, from about 8.5 to about 9.5, or from about 9 to about 10.

Suitable bases for treating the raw toner particles include metal hydroxides, such as sodium hydroxide, potassium hydroxide, ammonium hydroxide, and combinations thereof.

While the raw toner particles are being treated with the base, the mixture may also be cooled. For example, the temperature of the mixture may be cooled to a range of from about 60 to about 75° C., such as from about 60 to about 68° C., from about 66 to about 70° C., or from about 69 to about 75° C.

The base-treated raw toner particles may be washed and dried. Then, the base-treated raw toner particles may be mixed with one or more external additives to obtain a blended toner composition containing blended toner particles.

External Additives

Suitable external additives include any additive that enhances the properties of the toner composition. For example, the toner may include positive or negative charge control agents in an amount of from about 0.1 to about 10 wt % of the toner, such as from about 1 to about 5 wt %, or from about 1 to about 3 wt %. Examples of suitable charge control agents include quaternary ammonium compounds inclusive of alkyl pyridinium halides; bisulfates; alkyl pyridinium compounds, including those disclosed in U.S. Pat. No. 4,298,672, the entire disclosure of which is totally incorporated herein by reference; organic sulfate and sulfonate compositions, including those disclosed in U.S. Pat. No. 4,338,390, the entire disclosure of which is totally incorporated herein by reference; cetyl pyridinium tetrafluoroborates; distearyl dimethyl ammonium methyl sulfate; aluminum salts such as BONTRON E88™, or zinc salts such as E-84 (Orient Chemical); combinations thereof, and the like.

Other additives include organic spacers, such as polymethylmethacrylate (PMMA). The organic spacer may have a volume average diameter of from about 300 to about 600 nm, such as from about 300 to about 400 nm, or from about 350 to about 450 nm, such as 300 nm, 350 nm, 400 nm, 450 nm, or 500 nm.

Other additives include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives may each be present in an amount of from about 0.1 to about 10 wt % of the toner particles, such as from about 0.5 to about 7 wt %. Examples of such additives include, for example, those disclosed in U.S. Pat. Nos. 3,590,000; 3,720,617; 3,655,374; and 3,983,045, the entire disclosures of which are totally incorporated herein by reference. Other additives include zinc stearate and AEROSIL R972® available from Degussa. The coated silicas of U.S. Pat. Nos. 6,190,815 and 6,004,714, the entire disclosures of which are totally incorporated herein by reference, may also be selected in amounts, for example, of from about 0.05 to about 5 wt % of the toner particles, such as from about 0.1 to about 2 wt %. These additives may be added during the aggregation or blended into the formed toner product.

Toner Properties

Emulsion aggregation processes provide greater control over the distribution of toner particle sizes and by limiting the amount of both fine and coarse toner particles in the toner. In some embodiments, the toner particles have a relatively narrow particle size distribution with a lower number ratio geometric standard deviation (GSDn) of from about 1.15 to about 1.40, such as from about 1.15 to about 1.25, or from about 1.20 to about 1.35. The toner particles may also exhibit an upper geometric standard deviation by volume (GSDv) in the range of from about 1.15 to about 1.35, such as from about 1.15 to about 1.21, or from about 1.18 to about 1.30.

As a result of the above described method, a triboelectric charge ratio of a triboelectric charge of the blended toner composition to a triboelectric charge of the base-treated raw toner particles is from about 0.8 to about 1.2, such as from about 0.8 to about 1.0, from about 0.9 to about 1.1, or from about 1.0 to about 1.2. The triboelectric charge ratios may be affected by the amount of base used to treat the raw toner particles as well as the temperature of the mixture while the raw toner particles are being treated by the base.

Particularly, the base-treated raw toner particles may have a triboelectric charge of from about 26 to about 58 μC/g, such as from about 32 to about 48 μC/g, from about 38 to about 48 μC/g, or from about 48 to about 58 μC/g.

Similarly, the blended toner composition may have a triboelectric charge of from about 32 to about 48 μC/g, such as from about 36 to about 44 μC/g, from about 38 to about 48 μC/g, or from about 40 to about 48 μC/g.

As a result of the above described method, a degree of attachment between the base-treated raw toner particles and the at least one surface additive is from about 10% to about 40%, such as from about 10% to about 25%, from about 20% to about 35%, or from about 30% to about 40%. The degree of attachment between the base-treated raw toner particle and the surface additives refers to the percentage of surface additives that remain attached to the surface of the raw toner particle after it has been sonicated at different levels of energy, generally from about 3000 to about 12,000 Joules. The percentage of additive remaining on the base-treated raw toner particle surface is based on the initial amount of additive that was on the base-treated raw toner particle before it was sonicated. The degree of attachment may be measured by Additive Attachment Force Distribution (AAFD) as described, for example, in U.S. Pat. No. 6,599,673, the entire disclosure of which is totally incorporated herein by reference.

The blended toner particles may have a surface area of greater than about 1.5 $m^2/g$, greater than about 1.8 $m^2/g$, or greater than about 1.9 $m^2/g$, such as from about 1.5 to about 2.0 $m^2/g$. Surface area may be determined by the Brunauer, Emmett, and Teller (BET) method. BET surface area of a sphere can be calculated by the following equation:

$$\text{Surface Area}(m^2/g)=6/(\text{Particle Diameter}(um)*\text{Density}(g/cc)).$$

The characteristics of the toner particles may be determined by any suitable technique and apparatus and are not limited to the instruments and techniques indicated hereinabove.

Imaging

Toners in accordance with the present disclosure may be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure may be selected for electrophotographic imaging and printing processes such as digital imaging systems and processes.

Any known type of image development system may be used in an image developing device to form images with the toner set described herein, including, for example, magnetic brush development, single component development (SCD), two component development (TCD), hybrid scavengeless development (HSD), and the like.

EXAMPLES

The following Examples are illustrative only and are not intended to limit the scope of the present disclosure. Parts and percentages are by weight unless otherwise indicated. "Room temperature" refers to a temperature of from about 20° C. to about 30° C.

A toner composition containing raw toner particles was made via an emulsion aggregation process. A latex made of a styrene-n-butyl acrylate copolymer was added to a 20 gallon reactor, and was used for both the core and the shell of the toner particles. The toner composition also included 11 wt % wax, 80% of which was a Fischer-Tropsch wax and the remaining 20% was a Parrafin wax.

The reaction vessel was initially charged with 33.9 kg of de-ionized water, 14.9 kg of a styrene-n-butyl acrylate copolymer in a latex emulsion having a solids content of about 41.5%, and about 4.16 kg of a carbon black pigment dispersion having a solids content of about 17%. The content in the reactor was mixed together before adding 3.2 kg of a polyethylene wax dispersion having a solids content of about 31%, 0.80 kg of a Fischer-Tropsch wax dispersion having a solids content of about 31%, and 1.8 kg of an acid solution with polyaluminum chloride as an agglomerating agent.

The wax dispersion was added through a homogenization loop to assure large agglomerates of the wax dispersion were broken down into smaller sized particles. After the wax dispersion and agglomerating agent solution were added to the reactor, all of the components in the reactor were homogenized until the size of the particles in the dispersion was within a target range. After the ingredients in the reactor were homogenized, the temperature of the mixture was raised to about 50.5° C., until the particles aggregated and reached the target size. At this point, the pre-shell aggregate or core formation containing raw toner particles was completed.

Once the raw toner particles reached the target size, an additional 7.58 kg of a styrene-n-butylacrylate copolymer in a latex emulsion was added into the reactor. The latex was mixed into the reactor until the particles reached their final target size and sufficient time had been allowed to incorporate all of the additional latex emulsion into the raw toner particles. When the final target size was reached, the shell formation step was completed, and the growth of the raw toner particles was stopped by the addition of sodium hydroxide until the slurry had a pH of from about 5.3 to about 5.5. Then, the batch target temperature was raised to a target of 96° C.

When the slurry reached a temperature of 80° C., its pH was adjusted by the addition of nitric acid until the pH of the slurry reached a value of 5.1 to 5.2. Once the batch reached 96° C., the temperature of the slurry was maintained, and the circularity of the raw toner particles was monitored over time. The batch was maintained at 96° C. for three hours. During that time, the raw toner particles reached their target shape. At the end of the three hour period, the temperature of the slurry was lowered to 63° C. at a rate of 0.45° C./min.

FIG. 1 is a SEM image of the resulting raw toner particles.

Figure 2:
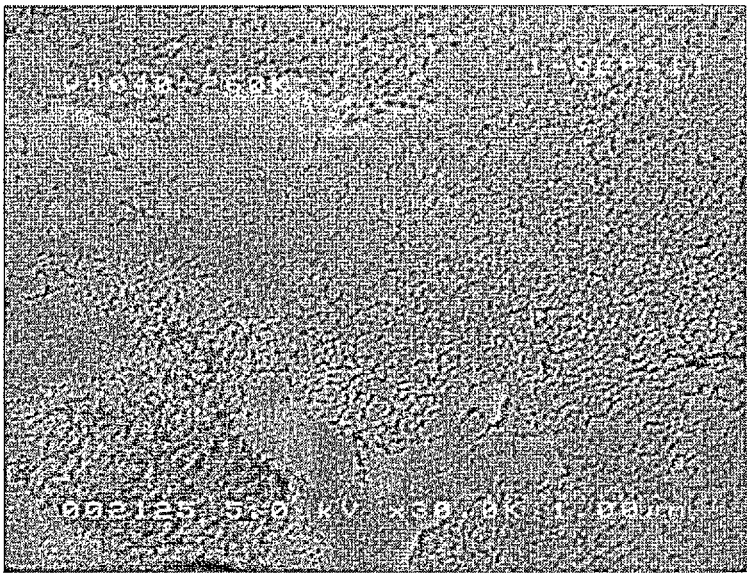
FIG. 2 is a SEM image of a base-treated raw toner particle.

The raw toner particles were then treated with 1200 g of a 4% NaOH solution at a temperature of about 70° C.]. FIG. 2 is a SEM image of the base-treated raw toner particles.

The base-treated raw toner particles were then blended in a 10 L Henschel blender using 1.75% of a surface additive from the silica family to control the mean charge of the blended toner particles, 0.75% of a surface additive from the titania family to control the mean charge and conductivity of the blended toner particles, 0.25% of a second surface additive from the titania family to control the charge distribution of the blended toner particles, and 0.9% of a surface additive from the linear polymeric alcohol family to provide lubrication. The base treated raw toner particles were blended with the surface additives for 16 minutes to form the blended toner particles.

The blended toner particles had an average BET specific surface area greater than 1.5 $m^2/g$.

Results

Charging

The charge of both the base-treated raw toner particle and the blended toner with additives was measured in an environment with low grains of water, which increases the charge of the toner materials and enables a clear signal when testing different toners. The analysis was performed using specific sodium hydroxide addition and the slurry temperature at which the addition was done as the factors. The specific sodium hydroxide addition was calculated from the sodium hydroxide content in the caustic solution and the solids concentration in the slurry, resulting in the specific concentration in grams of NaOH per kg of particle in the dispersion. The base-treated raw toner particle charge and the blended toner charge were inversely related relative to the control factors. Thus, it is possible to generate a toner composition that has equal base-treated raw toner particle charge and blended toner charge by varying these process parameters.

The ratio of toner charge to base-treated raw toner particle charge was calculated, and the amount of specific base added was determined to be a much stronger driver of charge than temperature. Particularly, treating the raw toner particles between 66° C. and 70° C. and adding a NaOH solution such that the base ratio is between 4 and 5 g NaOH/kg particle yielded a blended toner formulation with similar base-treated raw toner particle and blended toner triboelectric charge.

Treating the raw toner particles between 66° C. and 70° C. and adding a solution containing NaOH, such that the base ratio was between 4 and 5 g NaOH/kg particle, yielded a blended toner formulation with a triboelectric ratio of 0.8 to 1.2.

Additive Attachment

The residual amount of silica after sonicating the toner produced at 12K Joules of energy showed that the degree of strong attachment can be significantly increased by increasing the base ratio and, to a small extent, varying the temperature.

Increasing the temperature from 56° C. to 70° C. increased the degree of strong additive attachment from about 13% to about 27%. Additionally, increasing the base ratio from 0.75 to 5.12 increased the degree of strong additive attachment from almost 0% to 40%.

The degree of etching of the particle surface was affected by the amount of base added and the temperature. The base-treated raw toner particles had a BET specific surface area of greater than 1.7 $m^2/g$, while the raw toner particles had a BET specific surface of around 1.2.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making a toner composition, comprising:

combining a latex resin, an optional wax, and an optional colorant to form a slurry;

aggregating particles in the slurry;

coalescing the aggregated particles by heating the particles to produce coalesced raw toner particles;

increasing a surface area of the raw toner particles by contacting the raw toner particles with a base to produce base-treated raw toner particles having etching on a surface of the base-treated raw toner particles; and mixing the base-treated raw toner particles with at least one surface additive such that the at least one surface additive attaches to a surface of the base-treated raw toner particles to obtain blended toner particles.

2. The method of claim 1, wherein the raw toner particles are prepared by an emulsion aggregation process.

3. The method of claim 1, wherein the base is NaOH.

4. The method of claim 1, further comprising cooling the raw toner particles while treating the raw toner particles with the base to a temperature of from about 60° C. to about 75° C.

5. The method of claim 1, further comprising washing the raw toner particles after treating the raw toner particles with the base.

6. The method of claim 1, wherein a ratio of a triboelectric charge of the blended toner particles to a triboelectric charge of the base-treated raw toner particles is from about 0.8 to about 1.2.

7. The method of claim 1, wherein an amount of the base used to treat the raw toner particles is from about 3 g to about 6 g base per kg of the raw toner particles.

8. The method of claim 1, wherein a triboelectric charge of the raw toner particles is from about 26 μC/g to about 58 μC/g.

9. The method of claim 1, wherein a triboelectric charge of the base-treated raw toner particles is from about 32 μC/g to about 48 μC/g.

10. The method of claim 1, wherein a triboelectric charge of the blended toner particles is from about 32 μC/g to about 38 μC/g.

11. The method of claim 1, wherein the raw toner particles comprise a latex containing a styrene or acrylate monomer.

12. The method of claim 1, wherein a degree of attachment between the surface of the base-treated raw toner particles and the at least one surface additive is from about 10% to about 40%.

13. The method of claim 1, wherein a pH of the mixture of the raw toner particles and the base when the base is added to the raw toner particles is in a range of from about 8 to about 10.

14. A toner composition comprising blended toner particles comprising:

base-treated coalesced raw toner particles having etching on a surface of the base-treated raw toner particles; and at least one surface additive attached to the surface of the base-treated raw toner particles;

wherein a ratio of a triboelectric charge of the blended toner composition to a triboelectric charge of the base-treated raw toner particles is from about 0.8 to about 1.2.

15. The toner composition of claim 14, wherein a BET specific surface area of the base-treated raw toner particles is greater than about 1.5 $m^2/g$.

16. The toner composition of claim 14, wherein a degree of attachment between a surface of the base-treated raw toner particles and the at least one surface additive is from about 10% to about 40%.

17. The toner composition of claim 14, wherein the base-treated raw toner particles comprise a latex containing a styrene and an acrylate monomer.

18. The toner composition of claim 14, wherein the at least one surface additive is at least one additive selected from the group consisting of silica, titanias, and polymeric alcohols.

19. The toner composition of claim 14, wherein:

the triboelectric charge of the blended toner composition is from about 32 μC/g to about 48 μC/g; and the triboelectric charge of the base-treated raw toner particles is from about 26 μC/g to about 58 μC/g.

20. A toner composition comprising blended toner particles comprising:

base-treated coalesced raw toner particles having etching on a surface of the base-treated raw toner particles; and at least one surface additive attached to the surface of the base-treated raw toner particles;

wherein:

a degree of attachment between the base-treated raw toner particles and the at least one surface additive is from about 10% to about 40%;

a BET specific surface area of the base-treated raw toner particles is greater than about 1.5 $m^2/g$;

a ratio of a triboelectric charge of the blended toner particles to a triboelectric charge of the base-treated raw toner particles is from about 0.8 to about 1.2;

the triboelectric charge of the base-treated raw particles is from about 26 μC/g to about 58 μC/g; and the triboelectric charge of the blended toner particles is from about 32 μC/g to about 48 μC/g.

* * * * *